US011528965B2

(12) United States Patent
Spencer

(10) Patent No.: US 11,528,965 B2
(45) Date of Patent: Dec. 20, 2022

(54) BUCKLE ASSEMBLY WITH DISENGAGEMENT PREVENTION DEVICE

(71) Applicant: James W. Spencer, Clearwater, FL (US)

(72) Inventor: James W. Spencer, Clearwater, FL (US)

( * ) Notice: Subject to any disclaimer, the term of this patent is extended or adjusted under 35 U.S.C. 154(b) by 208 days.

(21) Appl. No.: 17/019,627

(22) Filed: Sep. 14, 2020

(65) Prior Publication Data

US 2022/0079299 A1 Mar. 17, 2022

(51) Int. Cl.

*A44B 11/00* (2006.01)
*A44B 11/26* (2006.01)
*A47D 15/00* (2006.01)

(52) U.S. Cl.

CPC ..... *A44B 11/006* (2013.01); *A44B 11/266* (2013.01); *A47D 15/00* (2013.01); *A44D 2211/00* (2013.01)

(58) Field of Classification Search

CPC . A44B 11/266; A44B 11/006; A44B 11/2592; A47D 15/00; A44D 2211/00; A45C 13/30
See application file for complete search history.

(56) References Cited

U.S. PATENT DOCUMENTS 4,825,515 A * 5/1989 Wolterstorff, Jr. ... A44B 11/263 24/615
5,144,725 A * 9/1992 Krauss ..... A44B 11/266 24/616
5,419,020 A * 5/1995 Murai ..... A44B 11/266 24/633
5,774,956 A * 7/1998 French ..... A44B 11/263 24/616
6,145,172 A * 11/2000 Bourdon ..... A44B 11/266 24/616
6,684,466 B2 * 2/2004 Nishida ..... A44B 11/266 24/615
7,513,020 B2 * 4/2009 Giampavolo ..... A44B 11/266 24/615
2010/0005632 A1 * 1/2010 Pigozzi ..... A45F 5/02 24/3.13

* cited by examiner

*Primary Examiner* — Robert Sandy
(74) *Attorney, Agent, or Firm* — DP IP Group; Franco De Liguori

(57) ABSTRACT

A buckle assembly with a disengagement prevention device and a method for using the same is disclosed. The buckle assembly has a first buckle member having a first strap holding structure configured to adjustably affix the first buckle member to a first strap segment. A second buckle member is configured to couple with the first buckle member, the second buckle member having a second strap holding structure configured to affix the second buckle member to a second strap segment. A disengagement prevention device is configured for engagement with the first and second buckle members to maintain the first and second buckle members in a coupled state under conditions where the first and second buckle members are not properly engaged or the engagement between the first and second buckle members is accidentally released.

20 Claims, 7 Drawing Sheets

BUCKLE ASSEMBLY WITH DISENGAGEMENT PREVENTION DEVICE

BACKGROUND

Field

The present disclosure relates generally to buckles, and more specifically, the present disclosure relates to a buckle assembly equipped with a disengagement prevention device.

Background Information

Buckles, such as side release buckles, are used in varied applications ranging from closures on backpacks to safety harnesses used in infant car seats, and rock-climbing harnesses. Side release buckles, when properly engaged, form a strong interconnect. However, side release buckles can become accidentally decoupled as, for example, when the male buckle member is not properly engaged with the female buckle member. Since side release buckles are often used to secure harnesses and other safety devices, a failure of such side release buckles can have catastrophic results. Thus, a need exists for a buckle assembly, such as of the side release buckle type, having a disengagement prevention device.

SUMMARY

In one aspect, the present disclosure provides a buckle assembly. In one embodiment, the buckle assembly includes a first buckle member having a first strap holding structure configured to adjustably affix the first buckle member to a first strap segment, and a second buckle member configured to couple with the first buckle member, the second buckle member having a second strap holding structure configured to affix the second buckle member to a second strap segment. A disengagement prevention device is configured for engagement with the first and second buckle members to maintain the first and second buckle members in a coupled state under conditions where the first and second buckle members are not properly engaged or the engagement between the first and second buckle members is accidentally released.

According to an embodiment of the present disclosure, the disengagement prevention device comprises a securing loop having a first side attached to the second buckle member and a second side configured to engage with the first buckle member. According to a feature of this embodiment, when the first buckle member becomes at least partially disengaged from the second buckle member, the second side of the securing loop becomes clamped between the first strap segment and the first buckle member.

In another embodiment, the buckle assembly includes a male buckle member, a female buckle member, and a disengagement prevention device configured for engagement with the male and female buckle members to maintain the male and female buckle members in a coupled state under conditions where the male and female buckle members are not properly engaged or the engagement between the male and female buckle members is accidentally released. The male buckle member includes an insertion portion having a pair of opposing locking structures disposed at a distal end of the insertion portion, and a first strap holding structure formed at a proximal end of the insertion portion, the first strap holding structure being configured to affix the male buckle member to a first strap segment. The female buckle member includes a receiving void and a second strap holding structure. The receiving void is configured to receive the insertion portion of the male buckle member and has openings extending perpendicular to a long axis of the female buckle member, the openings being configured to holdingly receive the respective locking structures. The second strap holding structure is formed opposite to the receiving void, the second strap holding structure being configured to affix the female buckle member to a second strap segment.

According to an embodiment of the present disclosure, the disengagement prevention device comprises a securing loop having a first side attached to the female buckle member and a second side configured to engage with the male buckle member. According to a feature of this embodiment, when the male buckle member becomes at least partially disengaged from the female buckle member, the second side of the securing loop becomes clamped between the first strap segment and the male buckle member.

In another aspect, the present disclosure is directed to a method for preventing disengagement of a buckle assembly when a locking structure of the buckle assembly is accidentally released. The buckle assembly has a disengagement prevention device configured for engagement with insertion and receiving members of the buckle assembly to maintain the insertion and receiving members in a coupled state under conditions where the insertion and receiving members are not properly engaged or the engagement between the insertion and receiving members is accidentally released. In an embodiment of the present disclosure, the disengagement prevention device comprises a securing loop attached to the receiving member. The method according to this embodiment comprises looping the securing loop about the insertion member, inserting the insertion member into a void formed on the receiving member, and engaging a locking structure of the insertion member with openings formed on the receiving member. Additionally, the method can include pulling a free end of a strap held by the insertion member through the securing loop.

In yet another aspect of the present disclosure, a buckle assembly with a disengagement prevention device is provided to an infant support structure. The infant support structure has a panel configured to be deployed upon a support frame between at least two anchor points of the support frame, an insert disposed within an aperture formed on the panel, and a plurality of buckle assemblies each for releasably securing the panel to the at least two anchor points of the support frame. Each of the buckle assemblies comprises first and second buckle members and a disengagement prevention device configured for engagement with the first and second buckle members to maintain the first and second buckle members in a coupled state under conditions where the first and second buckle members are not properly engaged or the engagement between the first and second buckle members is accidentally released. The first buckle member has a first strap holding structure configured to adjustably affix the first buckle member to a first strap segment. The second buckle member is configured to couple with the first buckle member, the second buckle member having a second strap holding structure configured to affix the second buckle member to a second strap segment.

In an embodiment of the infant support structure, the disengagement prevention device comprises a securing loop having a first side attached to the female buckle member and a second side configured to engage with the male buckle member.

In another embodiment of the infant support structure, the insert has a first planar configuration and a second non-planar configuration. Responsive to an infant being placed onto the insert, the insert undergoes an elastic deformation thereby transitioning from the first planar configuration into the second non-planar configuration in which the insert urges a spine of the infant into a convex curve.

BRIEF DESCRIPTION OF THE DRAWINGS

These and other features, aspects and advantages of the present disclosure will become better understood with regard to the following description, appended claims and accompanying drawings.

DETAILED DESCRIPTION

Figure 1:
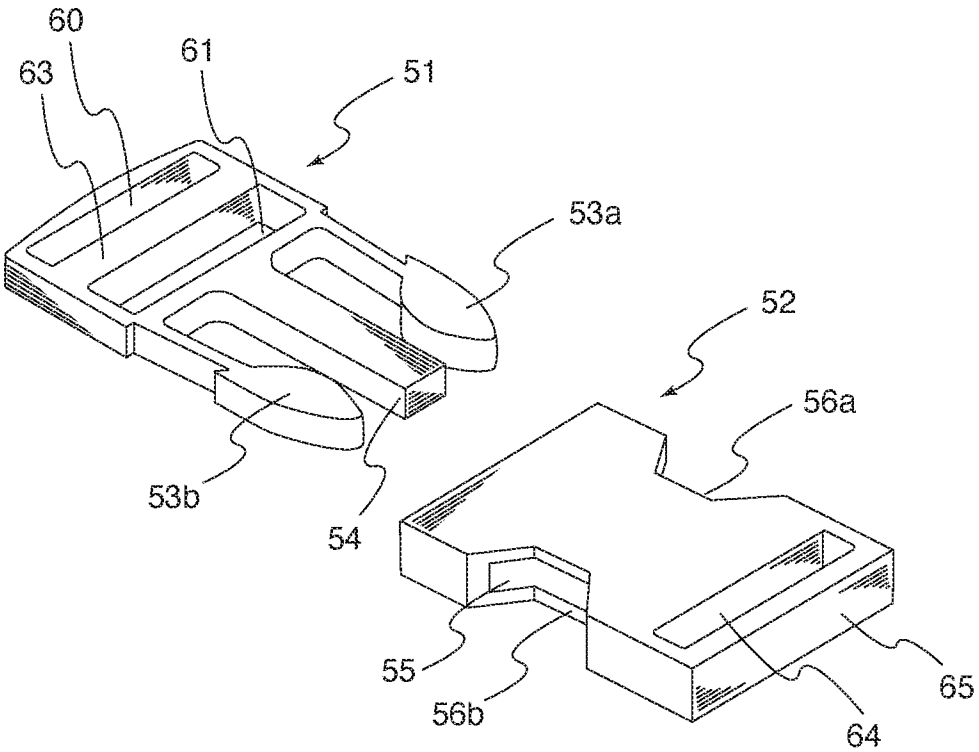
FIG. 1 shows buckle members used in a buckle assembly with a disengagement prevention device used in accordance with an embodiment of the present disclosure.

Buckle assemblies, such as those of the side release buckle type, provide a secure coupling for harnesses and closures. However, side release buckles can be susceptible to disengagement if not properly engaged or accidentally released. Embodiments of the present disclosure provide buckle assemblies and related methods and techniques for maintaining buckle members in a coupled state even under conditions where the buckle members are not properly engaged or the engagement between the buckle members is accidentally released.

Embodiments of the buckle assembly according to the present disclosure include a first buckle member with a first strap holding structure configured to adjustably affix the first buckle member to a first strap segment, and a second buckle member configured to couplingly engage with the first buckle member, where the second buckle member has a second strap holding structure configured to affix the second buckle member to a second strap segment. A disengagement prevention device is configured for engagement with the first and second buckle members to maintain the first and second buckle members in a coupled state under conditions where the first and second buckle members are not properly engaged or the engagement between the first and second buckle members is accidentally released.

Embodiments of the present disclosure are described herein with reference to FIGS. 1-7B. Throughout the disclosure, like elements are referenced by common reference numerals.

Figure 2:
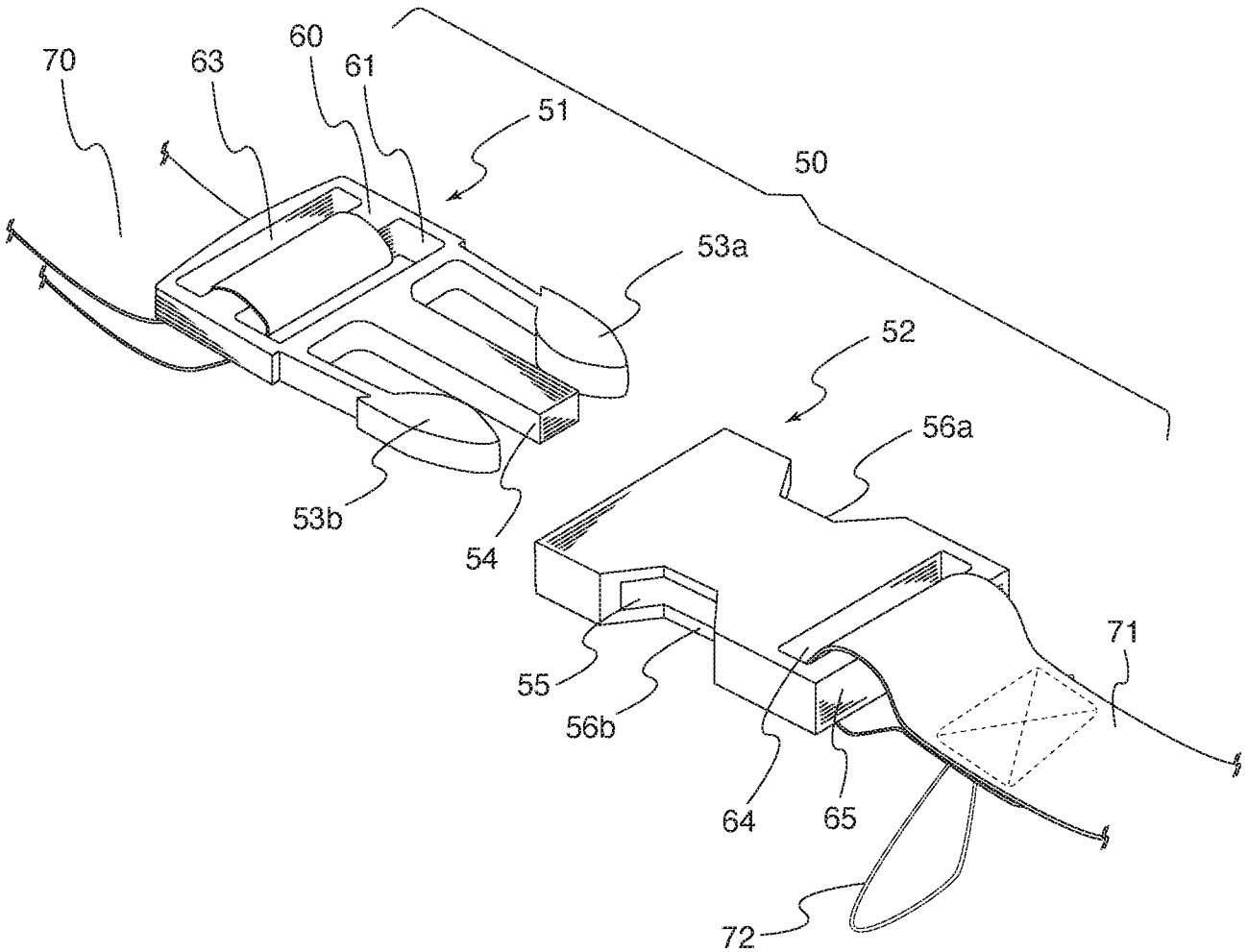
FIG. 2 shows a buckle assembly with a disengagement prevention device in accordance with an embodiment of the present disclosure.

FIGS. 1-3B illustrate an embodiment of a buckle assembly with a disengagement prevention device (hereinafter "buckle assembly") according to the present disclosure which is designated generally by numeral 50 in FIG. 2 and FIG. 3A.

FIG. 1 shows an embodiment of buckle members 51, 52 used in buckle assembly 50. Buckle members 51, 52 are male and female buckle members, respectively, commonly used in buckle assemblies of the side release buckle type which is configured to be unlocked from two opposite lateral sides. Male buckle member 51 (also referred to as an insertion member) includes two axially extended locking bars 53*a*, 53*b*, collectively forming a locking structure, and a center bar 54 spaced between the locking bars 53*a*, 53*b*. Female buckle member 52 (also referred to as a receiving member) has a void 55 formed thereon for receiving locking bars 53*a*, 53*b* and center bar 54 of male buckle member 51. Two side notches 56*a*, 56*b*, which are respectively formed as openings in the two opposite lateral sidewalls and extend into void 55, retain locking bars 53*a*, 53*b* of male buckle member 51.

Male buckle member 51 includes a first strap holding structure formed by a first through hole 61 and a second through hole 60 separated from each other by a cross member 63. Adjacent to a rear surface 65, female buckle member 52 has a through hole 64 forming a second strap holding structure.

When male buckle member 51 is inserted into void 55 of female buckle member 52, as shown in FIG. 3, locking bars 53*a*, 53*b* are forced by their resilient material property into engagement with the notches 56*a*, 56*b* to lock male buckle member 51 to female buckle member 52. Squeezing locking bars 53*a*, 53*b* inwards releases locking bars 53*a*, 53*b* from side notches 56*a*, 56*b*, disengaging male buckle member 51 from female buckle member 52.

Referring to FIG. 3, a first strap portion 70 is attached to male buckle member 51 by threading an end of the first strap portion 70 through first through hole 61, over cross member 63 and through second through hole 60. A second strap portion 71 is attached to female buckle member 52 by threading a free end of the second strap portion 71 through the second strap holding structure (e.g., the through hole 64). The free end of second strap portion 71 is further looped over rear surface 65 of female buckle member 52 and joined to another region of second strap portion 71.

In one embodiment, the free end and the other region of second strap portion 71 can be joined by stitching, such as a box stitch, for example. In other embodiments, the free end and the other region of the second strap portion 71 can be joined by welding, for example, in cases where second strap portion 71 is constructed of a plastic material, such as nylon. In still other embodiments, the free end and the other region of second strap portion 71 can be joined using rivets or clamps. Other means for joining the free end and the other region of second strap portion 71 are suitable without departing from the spirit and scope of the present disclosure.

Figure 3A:
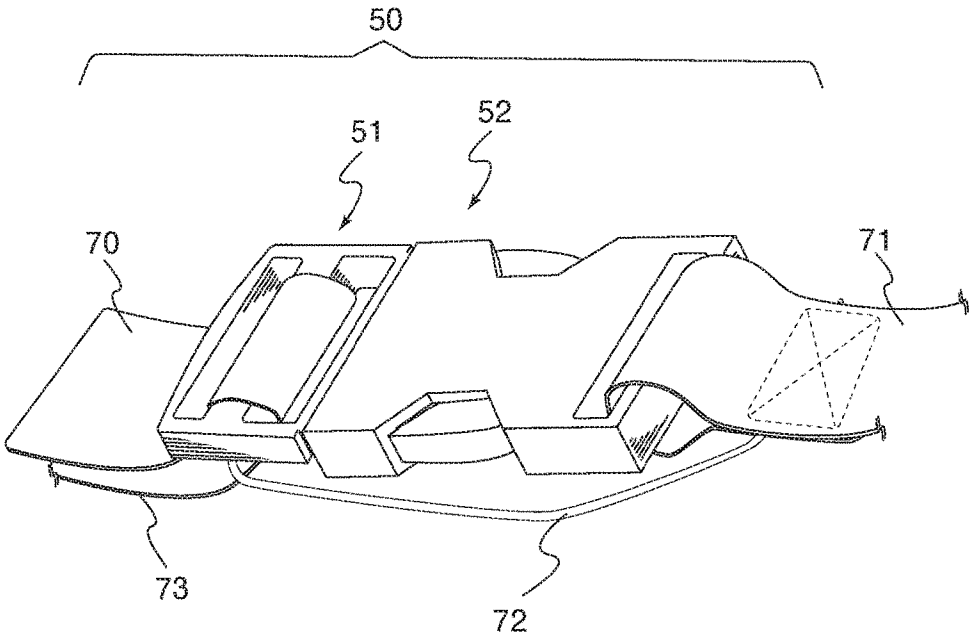
FIG. 3A shows the buckle assembly of FIG. 2 in a disengaged state in accordance with an embodiment of the present disclosure.

Buckle assembly 50 includes a disengagement prevention device configured for engagement with male and female buckle members 51, 52 to maintain the buckle members 51, 52 in a coupled state under conditions where buckle members 51, 52 are not properly engaged or the engagement between buckle members 51, 52 is accidentally released. In the present embodiment, the disengagement prevention device comprises a securing loop 72 attached to female buckle member 52 by way of the stitching, or other bonding method, used to join the free end and the other region of second strap portion 71. Securing loop 72, when engaged, as shown in FIG. 3A and described in greater detail below with reference to the flow diagram of FIG. 6, prevents male buckle member 51 from fully separating from female buckle member 52 in the case of a failure of the locking structure (e.g., locking bars 53*a*, 53*b*) properly engaging with side notches 56*a*, 56*b* of female buckle member 52. Failure can be a result of locking bars 53*a*, 53*b* not fully engaging with side notches 56*a*, 56*b*, inadvertent release of locking bars 53*a*, 53*b* from side notches 56*a*, 56*b*, and breakage of one or both of locking bars 53*a*, 53*b*, for example.

FIG. 3A shows securing loop 72 in an engaged configuration. As shown, a first side of securing loop 72 is secured to female buckle member 52. A second side of securing loop 72 is secured around male buckle member 51 between male buckle member 51 and an extending portion 73 of first strap portion 70. In this configuration, if male buckle member 51 and female buckle member 52 become decoupled from one another, as shown in FIG. 3B, securing loop 72 securely maintains male buckle member 51 and female buckle member 52 in close proximity to each other, thus preventing complete release of buckle assembly 50.

Figure 3B:
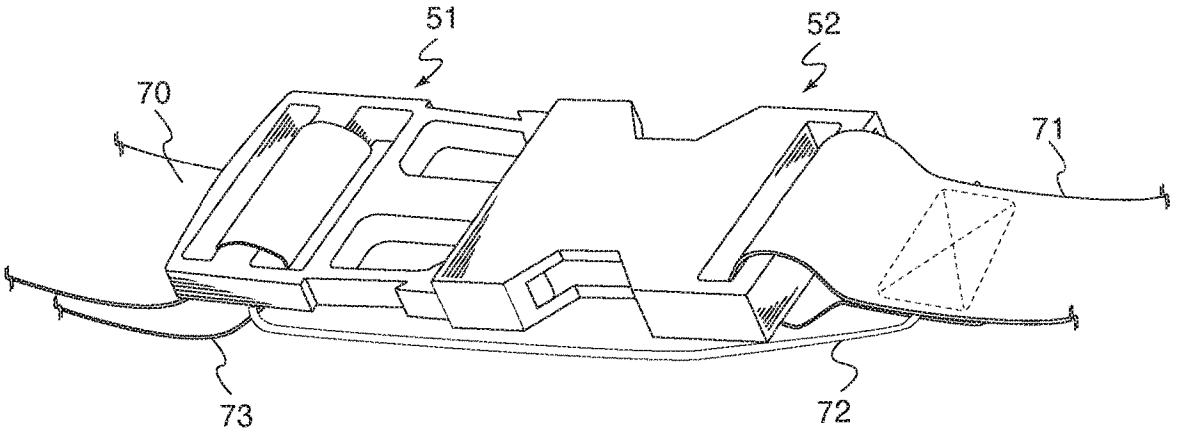
FIG. 3B shows the buckle assembly of FIG. 2 in a partially disengaged state where the disengagement prevention device prevents full disengagement of the buckle assembly in accordance with an embodiment of the present disclosure.

When male buckle member 51 is decoupled from female buckle member 52 as shown in FIG. 3B, securing loop 72 becomes clamped between a surface of male buckle member 51 and extended portion 73 of first strap portion 70. Extended portion 73 is the part of the first strap that is affixed, at its end, to some object, such as a flap of a backpack or a segment of a harness. Since extended portion 73 is unable to release from the object it is attached to, extended portion 73 becomes pulled taut by securing loop 72. Thus, extended portion 73 is drawn towards male buckle member 51, resulting in securing loop 72 becoming trapped therebetween.

Securing loop 72 can be fabricated from nylon paracord, for example. In other embodiments, securing loop 72 can be fabricated from rubber or other elastic material. In embodiments where securing loop 72 is an elastic material, the material can be selected based on an appropriate elasticity for the intended application. Thus, a material having a lower elasticity, or requiring greater force to stretch the material, can be selected for applications where separation of male buckle member 51 and female buckle member 52 during a failure is to be kept to a minimum, such as in safety harnesses and the like, for example. Other flexible, elastic or nonelastic materials having appropriate load bearing strength are also suitable for securing loop 72. For example, nylon paracord can have a strength of up to 600 pounds test. In some embodiments, nylon paracord having a load bearing strength of 200 pounds test can be used. The particular load bearing strength of securing loop 72 can be dictated by the intended application needs, and thus is not limited to the strengths provided herein.

It can be appreciated by one of ordinary skill in the art, in light of the description herein of the various exemplary embodiments, that the present disclosure is not limited to having securing loop 72 attached to female buckle member 52. Rather, in some embodiments, securing loop 72 can be attached to male buckle member 51, while female buckle member 52 is configured to provide an adjustable strap length.

Figure 4:
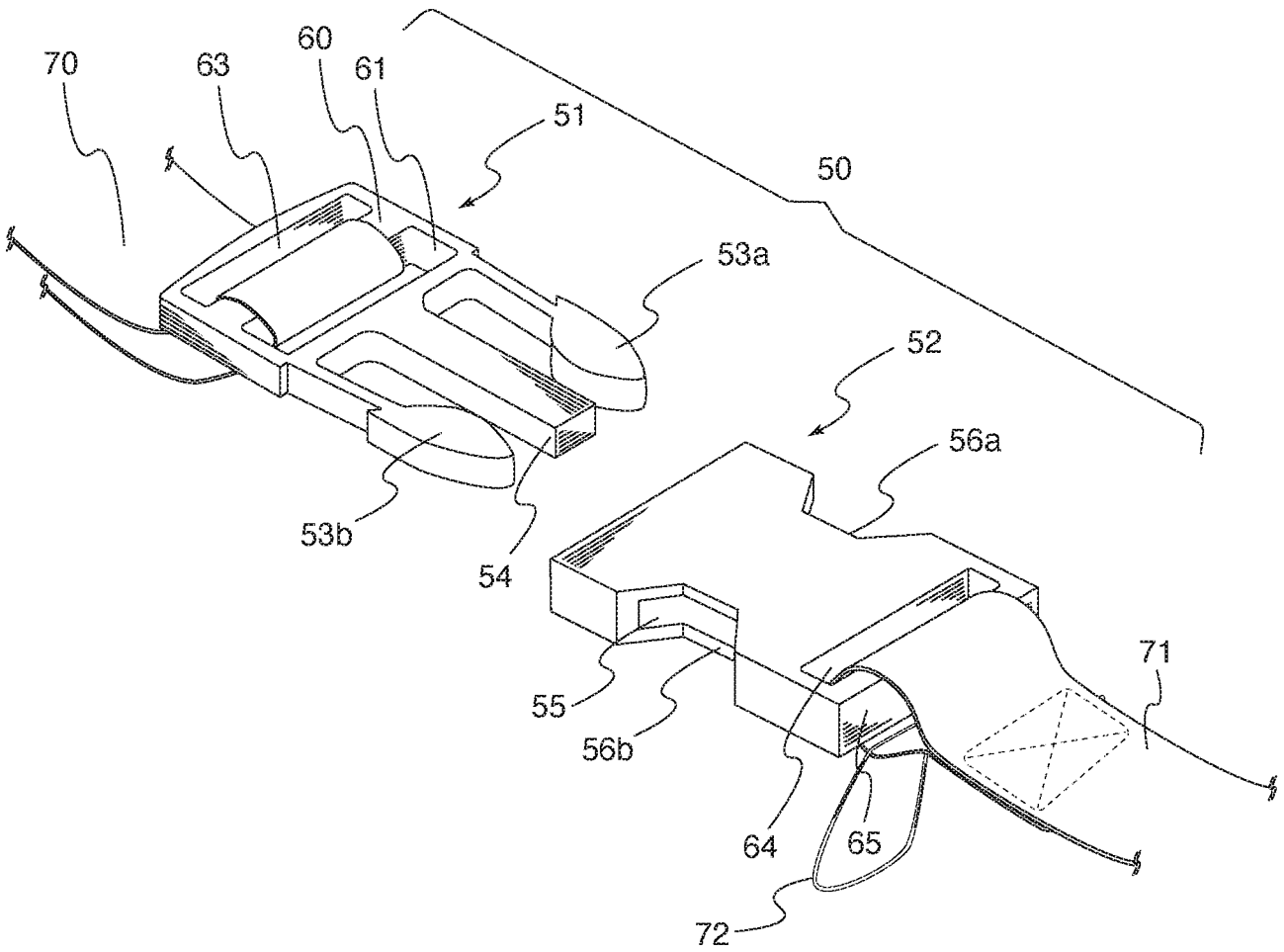
FIG. 4 shows a buckle assembly with a disengagement prevention device in accordance with another embodiment of the present disclosure.
Figure 5:
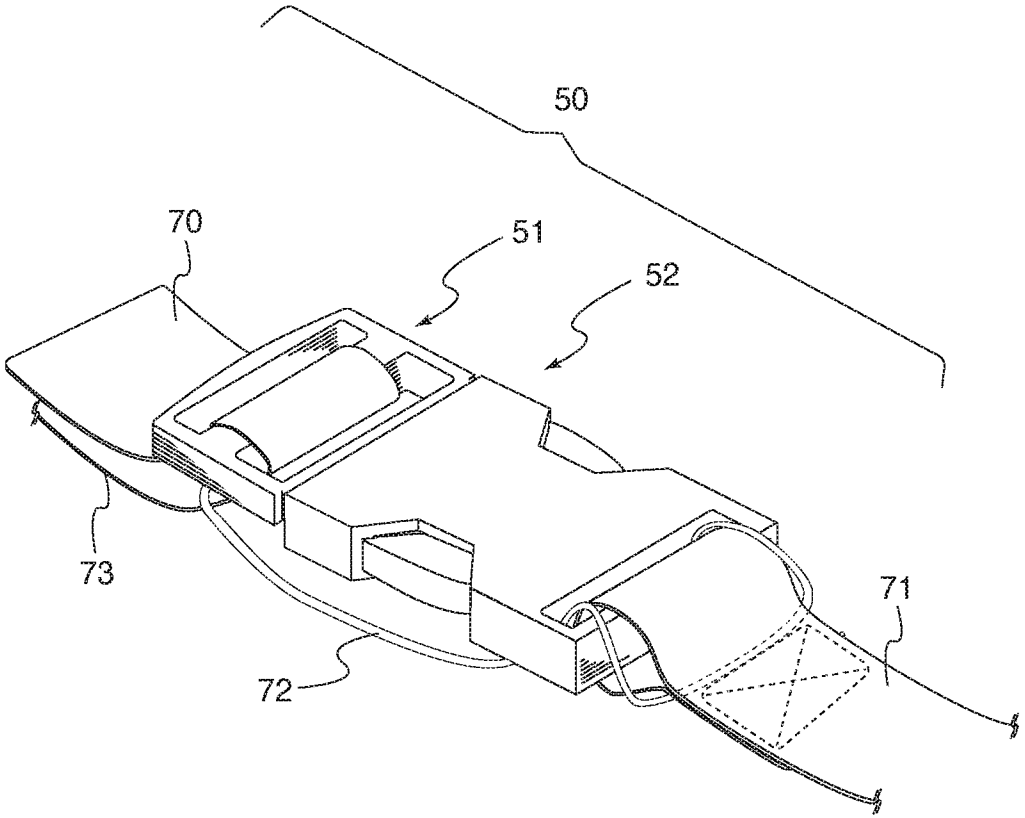
FIG. 5 shows a buckle assembly with a disengagement prevention device in accordance with another embodiment of the present disclosure.

FIG. 4 and FIG. 5 show other configurations for attaching securing loop 72 to the side release buckle assembly 50 according to other embodiments of the present disclosure.

In FIG. 4, the first end of securing loop 72 is attached to female buckle member 52 by way of the loop formed by the joining of the free end of second strap portion 71 and the other region of second strap portion 71. In this configuration, securing loop 72 is not held by the stitching used to join the free end of second strap portion 71 and the other region of second strap portion 71, thus avoiding situations where the stitching may weaken the integrity of securing loop 72 caused by perforation of securing loop 72 by the thread.

FIG. 5 shows another configuration for attaching securing loop 72 to buckle assembly 50. In the embodiment shown in FIG. 5, securing loop 72 can be provided as a separated device, rather than integrated with buckle assembly 50. In the present embodiment, securing loop 72 can be provided as an after-market device. As shown in FIG. 5, securing loop 72 can be attached to female buckle member 52 by passing female buckle member 52 through securing loop 72 such that second strap portion 71 is in contact with a side of securing loop 72. The free side of securing loop 72 is then looped through through-hole 64 (second strap holding structure). The free side of securing loop 72 can then be engaged with male buckle member 51 as described above with respect to FIG. 3A.

In other embodiments, the free side of securing loop 72 can be looped around male buckle member 51 in a similar manner as used with female buckle member 52 shown in FIG. 5. In the present embodiment, securing loop 72 can be disengaged from either female buckle member 52 or male buckle member 51 without deviating from the present disclosure.

Figure 6:
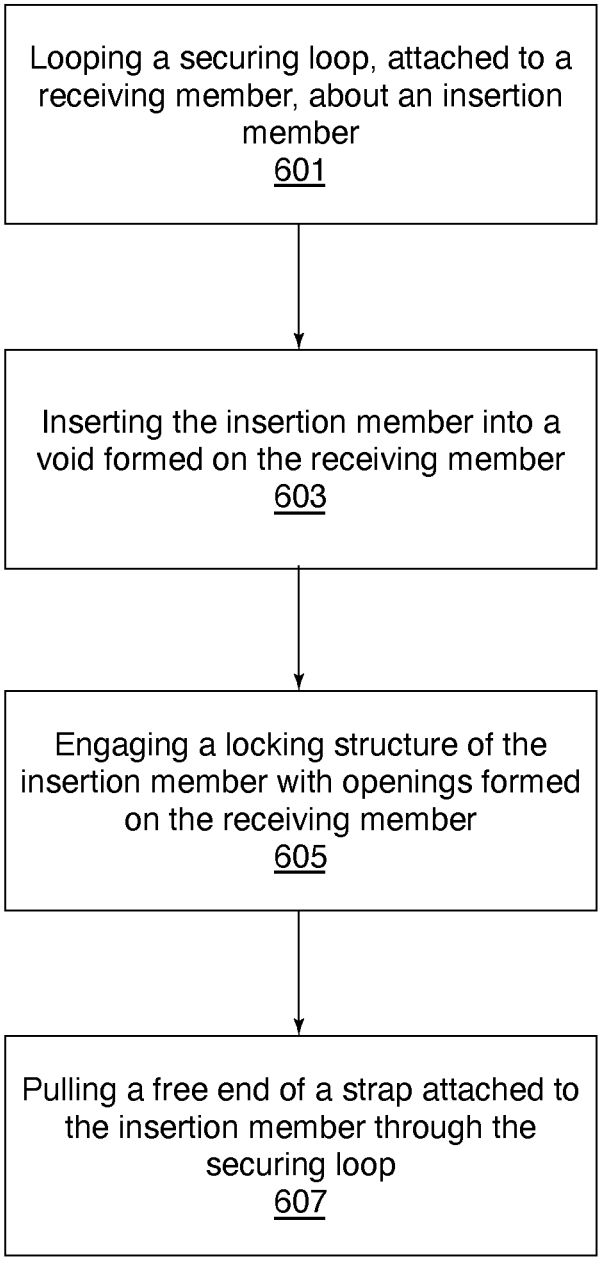
FIG. 6 shows a flow diagram illustrating a method for engaging the buckle assembly with a disengagement prevention device, in accordance with an embodiment of the present disclosure.

FIG. 6 presents a flow diagram showing a process for engaging the securing loop in accordance with some embodiments of the present disclosure. At block 601, securing loop 72, attached to a receiving member (female buckle member 52), is looped about an insertion member (male buckle member 51). Insertion member 51 is inserted into a void formed on receiving member 52 at block 603. At block 605, the locking structure (locking bars 53*a*, 53*b*) of insertion member 51 engages with openings (side notches 56*a*, 56*b*) formed on receiving member 52. Once insertion member 51 is coupled to receiving member 52, a free end of a strap 70 held by insertion member 51 is pulled through securing loop 72 at block 607. Releasing securing loop 72 from insertion member 51 is accomplished by performing the process shown in FIG. 6 in reverse, starting with block 607 and ending with block 601.

Figure 7B:
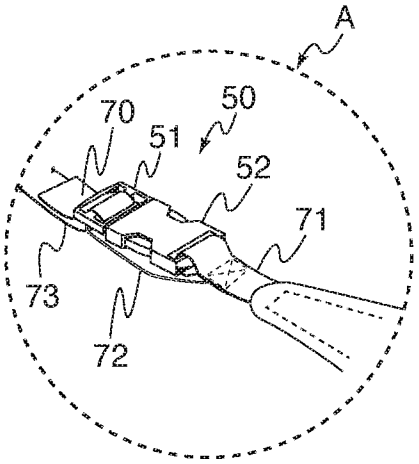
FIG. 7B shows an enlarged view of region A shown in FIG. 7A.
Figure 7A:
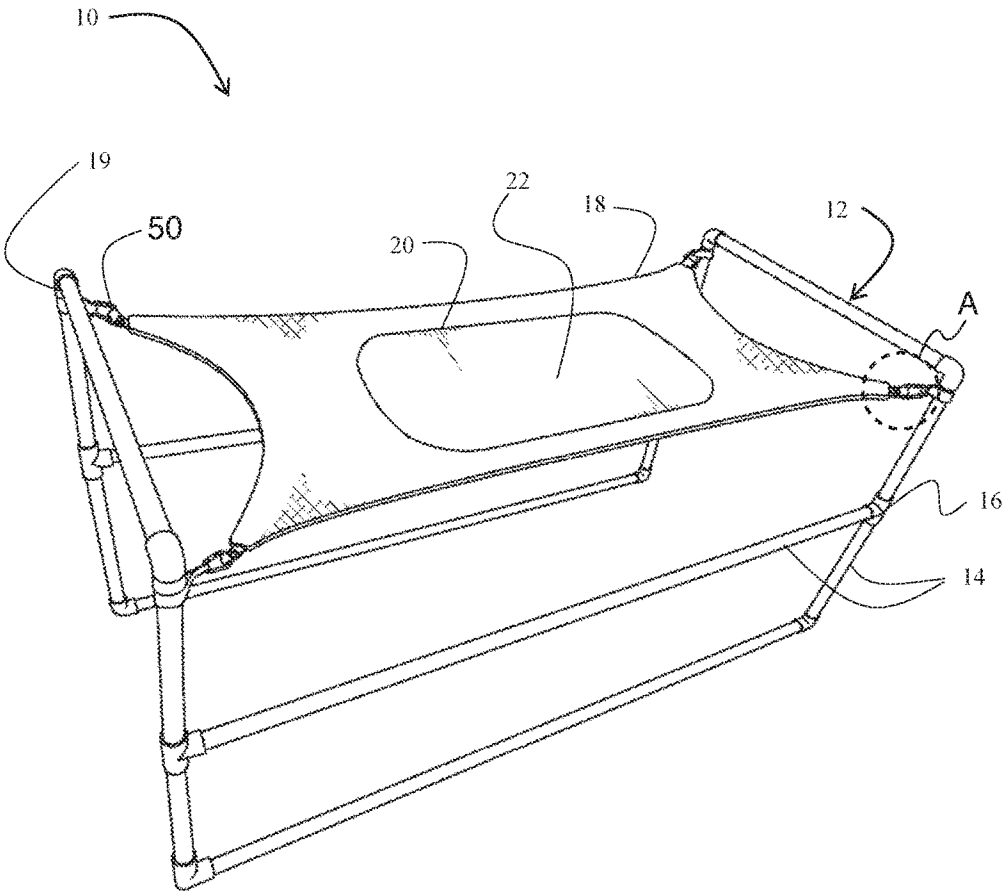
FIG. 7A shows an application of the buckle assembly with a disengagement prevention device in accordance with embodiments of the present disclosure.

FIG. 7A-7B show an example of an embodiment of the present disclosure employed in a practical application, namely an infant support structure as disclosed in the inventor's U.S. Pat. No. 9,943,175, which is incorporated herein by this reference in its entirety.

FIG. 7A depicts an infant support device 10. Infant support device 10 has a support frame 12 comprising a plurality of interconnected support frame members 14. Support frame 12 is configured to support a load exerted onto it by a weight of an infant with a predetermined factor of safety. Support frame 12 can be made of any material having sufficient strength to withstand such loads. The materials may include plastics, wood, an array of metals and their alloys, and combinations thereof.

In an embodiment, support frame members 14 are configured to interconnect with one another to form support frame 12 either by mating directly with one another or via couplings 16. Infant support device 10 further includes a fabric panel 18 disposed between four anchor points 19 on support frame 12. Fabric panel 18 has an aperture 20 within which mesh insert 22 is disposed.

Fabric panel 18 is attached to each of anchor points 19 (four in this embodiment) by way of a buckle assembly 50 affixed to each of four corners of fabric panel 18. Buckle assembly 50 corresponds to buckle assembly 50 described above with reference to the embodiment of FIGS. 1-3B and as shown in enlarged region A shown in FIG. 7B. Buckle assembly 50 is equipped with securing loop 72 in the manner described above with reference to FIGS. 1-3B. With the securing loop 72 engaged, buckle assembly 50 is prevented from fully releasing unintentionally, as described above for buckle assembly 50 in the embodiment of FIGS. 1-3B, thus reducing the risk of the infant support device 10 decoupling from the support frame 12 while an infant is being held thereby. It is understood that buckle assemblies 50 described above with reference to the embodiments of FIGS. 4 and 5 can also be alternatively used in the infant support device 10 without departing from the spirit and scope of the present disclosure.

The above-described aspects and embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A buckle assembly comprising:

a first buckle member having a first strap holding structure configured to adjustably affix the first buckle member to a first strap segment;

a second buckle member configured to couple with the first buckle member, the second buckle member having a second strap holding structure configured to affix the second buckle member to a second strap segment; and a disengagement prevention device configured for engagement with the first and second buckle members to maintain the first and second buckle members in a coupled state under conditions where the first and second buckle members are not properly engaged or the engagement between the first and second buckle members is accidentally released.

2. The buckle assembly as in claim 1, wherein the disengagement prevention device comprises a securing loop having a first side attached to the second buckle member and a second side configured to engage with the first buckle member.

3. The buckle assembly as in claim 2, wherein the securing loop is constructed of a flexible material.

4. The buckle assembly as in claim 2, wherein the first side of the securing loop is sewn between portions the second strap segment.

5. The buckle assembly as in claim 2, wherein when the first buckle member becomes disengaged from the second buckle member, the second side of the securing loop becomes clamped between the first strap segment and the first buckle member.

6. The buckle assembly as in claim 2, wherein the first side of the securing loop is secured to the second buckle member by looping the securing loop through the second strap holding structure and around the second buckle member.

7. The buckle assembly as in claim 2, wherein the first side of the securing loop is held in proximity to the second buckle member by a loop of the second strap segment.

8. The buckle assembly as in claim 7, wherein the loop of the second strap segment is formed by a free end of the second strap segment passed through the second strap holding structure and joined to a remaining portion of the second strap segment.

9. The buckle assembly as in claim 8, wherein the free end of the second strap segment is joined to a remaining portion of the second strap segment using a box stitch.

10. The buckle assembly as in claim 8, wherein the free end of the second strap segment is joined to a remaining portion of the second strap segment by heat welding.

11. The buckle assembly as in claim 8, wherein the free end of the second strap segment is joined to a remaining portion of the second strap segment using a rivet.

12. A buckle assembly, comprising:

a male buckle member including:

an insertion portion having a pair of opposing locking structures disposed at a distal end of the insertion portion, and a first strap holding structure formed at a proximal end of the insertion portion, the first strap holding structure being configured to affix the male buckle member to a first strap segment;

a female buckle member including:

a receiving void configured to receive the insertion portion of the male buckle member, the receiving void having openings extending perpendicular to a long axis of the female buckle member, the openings being configured to holdingly receive the respective locking structures, and a second strap holding structure formed opposite to the receiving void, the second strap holding structure being configured to affix the female buckle member to a second strap segment; and a disengagement prevention device configured for engagement with the male and female buckle members to maintain the male and female buckle members in a coupled state under conditions where the male and female buckle members are not properly engaged or the engagement between the male and female buckle members is accidentally released.

13. The buckle assembly as in claim 12, wherein the disengagement prevention device comprises a securing loop having a first side attached to the female buckle member and a second side configured to engage with the male buckle member.

14. The buckle assembly as in claim 13, wherein the securing loop is constructed of a flexible material.

15. The buckle assembly as in claim 14, wherein the flexible material is nylon paracord.

16. The buckle assembly as in claim 13, wherein the first side of the securing loop is sewn between portions the second strap segment.

17. The buckle assembly as in claim 13, wherein the first side of the securing loop is held in proximity to the female buckle member by a loop of the second strap segment formed by a free end of the second strap segment passed through the second strap holding structure and joined to a remaining portion of the second strap segment.

18. The buckle assembly as in claim 17, wherein the free end of the second strap segment is joined to a remaining portion of the second strap segment using a box stitch.

19. A method for preventing disengagement of a buckle assembly when a locking structure of the buckle assembly is accidentally released, the method comprising:

looping a securing loop, attached to a receiving member, about an insertion member;

inserting the insertion member into a void formed on the receiving member; and engaging a locking structure of the insertion member with openings formed on the receiving member.

20. An infant support structure comprising:

a panel configured to be deployed upon a support frame between at least two anchor points of the support frame;

an insert disposed within an aperture formed on the panel; and at least two buckle assemblies according to claim 1 each for releasably securing the panel to the respective at least two anchor points of the support frame.

* * * * *